US011116267B2

(12) United States Patent
Leeflang

(10) Patent No.: US 11,116,267 B2
(45) Date of Patent: Sep. 14, 2021

(54) FALSE EYELASH APPLICATION AND REMOVAL APPARATUS

(71) Applicant: Conchita Leeflang, Beverly Hills, CA (US)

(72) Inventor: Conchita Leeflang, Beverly Hills, CA (US)

( * ) Notice: Subject to any disclaimer, the term of this patent is extended or adjusted under 35 U.S.C. 154(b) by 929 days.

(21) Appl. No.: 15/618,071

(22) Filed: Jun. 8, 2017

(65) Prior Publication Data

US 2018/0098591 A1 Apr. 12, 2018

Related U.S. Application Data

(60) Provisional application No. 62/406,330, filed on Oct. 10, 2016.

(51) Int. Cl.

| | |
|---|---|
| ***A41G 5/02*** | (2006.01) |
| ***A41G 5/00*** | (2006.01) |
| *A45D 44/00* | (2006.01) |

(52) U.S. Cl.

CPC ..... *A41G 5/02* (2013.01); *A41G 5/0086* (2013.01); *A45D 44/00* (2013.01)

(58) Field of Classification Search

CPC ... A41G 5/02; A45D 1/00; A45D 2/00; A45D 2/48; A45D 40/30; A45D 44/00; A61B 17/28; A61B 17/30; A61B 17/282

USPC ..... 132/216–217; D28/36, 55

See application file for complete search history.

(56) References Cited

U.S. PATENT DOCUMENTS

| | | | | |
|---|---|---|---|---|
| 1,960,687 | A * | 5/1934 | Wills | A41G 5/02 606/205 |
| 5,598,858 | A * | 2/1997 | Wainer | A45D 2/48 132/216 |
| 5,797,958 | A * | 8/1998 | Yoon | A61B 17/122 606/139 |
| D437,086 | S * | 1/2001 | Dickert | D28/36 |
| D823,538 | S | 7/2018 | Ruggaber | |
| 2005/0166939 | A1 | 8/2005 | Stroud | |
| 2007/0163613 | A1* | 7/2007 | Lee | A45D 34/04 132/216 |

* cited by examiner

*Primary Examiner* — Yogesh P Patel
*Assistant Examiner* — Jennifer Gill
(74) *Attorney, Agent, or Firm* — Edwin Tarver

(57) ABSTRACT

An apparatus for applying and removing false eyelashes includes a first eye ring and a second eye ring for a user's fingers, with the first eye ring fixedly coupled to a slide extending from a hub. The second eye ring controls a slider controller connected to a slider cable which moves a first applicator support along a slide. A second applicator support is mounted on the slide opposite the hub. A first applicator extends laterally from the first applicator support and a second applicator extends laterally from the second applicator support, and are fixed in parallel such that they come together when the first applicator support is urged toward the second applicator support by the slider cable.

13 Claims, 4 Drawing Sheets

FALSE EYELASH APPLICATION AND REMOVAL APPARATUS

RELATED APPLICATIONS

This application claims the priority filing date of U.S. provisional patent application Ser. No. 62/406,330, entitled "Sideways 90 Degrees Eyelash Applicator," which was filed on 10 Oct. 2016, which is incorporated here by reference in its entirety.

BACKGROUND

The present apparatus generally relates to beauty and beauty related products. More specifically, the present apparatus relates to a hand operated tool for installing false eyelashes on a user's eyelid, and removing false eyelashes from the user's eyelid.

False eyelashes, otherwise known as eyelash extensions, are known in the art. These typically comprise a band along which an adhesive is administered. Extending from the band are extensions, usually similar to human eyelashes, that may be longer and thicker than natural eyelashes. False eyelashes may also be highly decorative, made of filaments unlike human hair, and designed to augment costumes or make-up effects. In general the band of a false eyelash is affixed to the bottom of a user's upper eyelid, such that the user's eyelashes blend in with the false eyelashes. The adhesive used is preferably gentle, such that it is strong enough to retain the false eyelash in position through normal activities, including blinking, but weak enough to release the false eyelash when pulled away from the user's eyelid without damaging the user's skin.

Sized for installation on a user's eyelid, false eyelashes are typically very small and considerably flexible. One persistent problem with false eyelashes is the user's ability to install them using the user's fingers alone. In common use, the user obtains a set of false eyelashes, which usually come in a case having at least one pair of false eyelashes placed on a form fitting plastic sheet. The user must grasp the false eyelash by its filament "eyelashes" and manually apply the adhesive. While this step in the installation of the false eyelashes is not particularly difficult, a user will frequently get adhesive on the user's fingers in the process.

The more part of the installation process is manipulating the false eyelash, bearing adhesive, to place the band at the edge of the user's upper eyelid. Even persons skilled in the make-up arts, and long time users of false eyelashes have difficulty placing the band in the desired position. The user must bring the user's fingers close to the user's eye, and must close or partially close the eye in order to install the eyelash; a process which can be very difficult for persons with large fingers, persons wearing corrective glasses, or in unsuitable locations such as a dim environment, etc. Frequently, the false eyelash bends or is otherwise unintentionally deformed by the user's fingers, causing improper installation. A misplaced false eyelash, once installed, must be entirely removed, the user's eye and the false eyelash cleaned, and new adhesive applied before starting over.

Hence, what is needed is a tool that provides users the ability to secure a false eyelash, apply adhesive without contacting the adhesive material, and install the false eyelash on the user's eyelid with a minimum of effort without the limitations of existing techniques.

SUMMARY

An apparatus for applying and removing false eyelashes generally includes a handle portion made up of a first eye ring and a second eye ring, oriented similar to the eye rings on a pair of scissors. The handle portion, including the first eye ring and the second eye ring, is coupled to a hub which rotates, allowing the first eye ring and the second eye ring to rotate about the hub relative to each other. An applicator portion is also coupled to the hub, with the applicator portion including a slide. Also included in the applicator portion is a first applicator configured to move along the slide, and a second applicator positioned at the end of the slide distally from the hub.

The first applicator and the second applicator each have an arced member, which is disposed at an oblique angle to the slide. A slider controller is also connected, directly or indirectly, to the hub. The slide is configured, and controlled by the slider controller such that bringing the first eye ring and the second eye ring together urges the first applicator toward the second applicator for grasping the false eyelash with the arced members, either on a user's eyelid, or from a case containing the false eyelash.

The hub includes a first hub member connected, directly or indirectly, to the first eye ring, and a second hub member connected, also directly or indirectly, to the second eye ring. A first stem and a second stem each extend from the hub. The first stem supports the first eye ring and the second stem supporting the second eye ring. A slider cable is coupled to the slider controller.

The slide preferably comprises a first applicator support and a second applicator support, and the first applicator support and the second applicator support arranged to hold the arced members in a parallel configuration relative to the slide. Preferably the slide is characterized by at least one rail, with the first applicator arranged to move back and forth along the rail, toward and away from the hub. A first applicator support may be fixed on the rail, with a first applicator anchor affixed to the first applicator support, and the first applicator affixed to the first applicator anchor. Likewise, a second applicator support may be fixed at the end of the rail, with a second applicator anchor affixed to the second applicator support, and the second applicator affixed to the second applicator anchor.

The first applicator support preferably includes a notch, or similar fastening structure, wherein the first applicator is configured to seat in the notch thereby preserving the orientation of the first applicator relative to the handle portion. In one embodiment, the hub may be configured such that the first eye ring is in a fixed position relative to the slide and the second eye ring rotates about the hub relative to the slide.

The invention can also be characterized as an apparatus for applying and removing false eyelashes, including a handle portion comprising a first eye ring and a second eye ring. The first eye ring and the second eye ring are coupled to a hub having a first hub member rotatably affixed to a second hub member, and an applicator portion is coupled to the hub. The applicator portion includes a slider cable and a slide having a rail. The slider cable is coupled to a first applicator support and configured to slide along the rail, while a slider controller is affixed to the hub.

The applicator portion preferably also includes a second applicator support affixed to the rail distal from the hub. A first applicator is installed on the first applicator support and a second applicator is installed on the second applicator support, the first applicator and the second applicator each having an arced member, and the arced members are oriented in parallel. Preferably the hub is arranged such that the second eye ring and the slider controller rotate in tandem, and separating the first eye ring and the second eye ring cause the slider controller to pull the slider cable, thereby moving the first applicator support toward the hub along the rail and separating the arced members.

In one embodiment the first applicator support comprises a first applicator anchor and the first applicator includes a post for anchoring in the first applicator anchor. Likewise the second applicator support includes a second applicator anchor and the second applicator comprises a post for anchoring in the second applicator anchor. In another embodiment, the slide includes a parallel pair of rails, and the first applicator support includes a pair of rail guides for sliding along the pair of rails. Preferably the pair of rails are held parallel at either end by a slide support proximal to the hub and by the second applicator support distal to the hub.

Preferably the arced members are disposed substantially perpendicular to the slide. Additionally, the hub may be configured such that the first eye ring is in a fixed position relative to the slide and the second eye ring rotates about the hub relative to the slide.

The apparatus can also be characterized as an apparatus for applying and removing false eyelashes, the apparatus having a first eye ring and a second eye ring coupled to a hub in a scissoring arrangement, where the first eye ring is fixedly coupled to a slide extending from the hub. A slider controller is fixedly coupled to the second eye ring and a first applicator support is configured to slide along the slide. A second applicator support is mounted on the slide opposite the hub, with a slider cable connecting the slider controller and the first applicator support. A first applicator extends laterally from the first applicator support, and a second applicator extending laterally from the second applicator support. The first applicator and the second applicator are fixed substantially parallel to each other, such that they come together when the first applicator support is urged toward the second applicator support by the slider cable. Preferably the first applicator and the second applicator each comprise an arced member, and the arced members are oriented substantially perpendicular to the first eye ring and the second eye ring.

DETAILED DESCRIPTION

The following description is presented to enable any person skilled in the art to make and use the invention, and is provided n the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Figure 1:
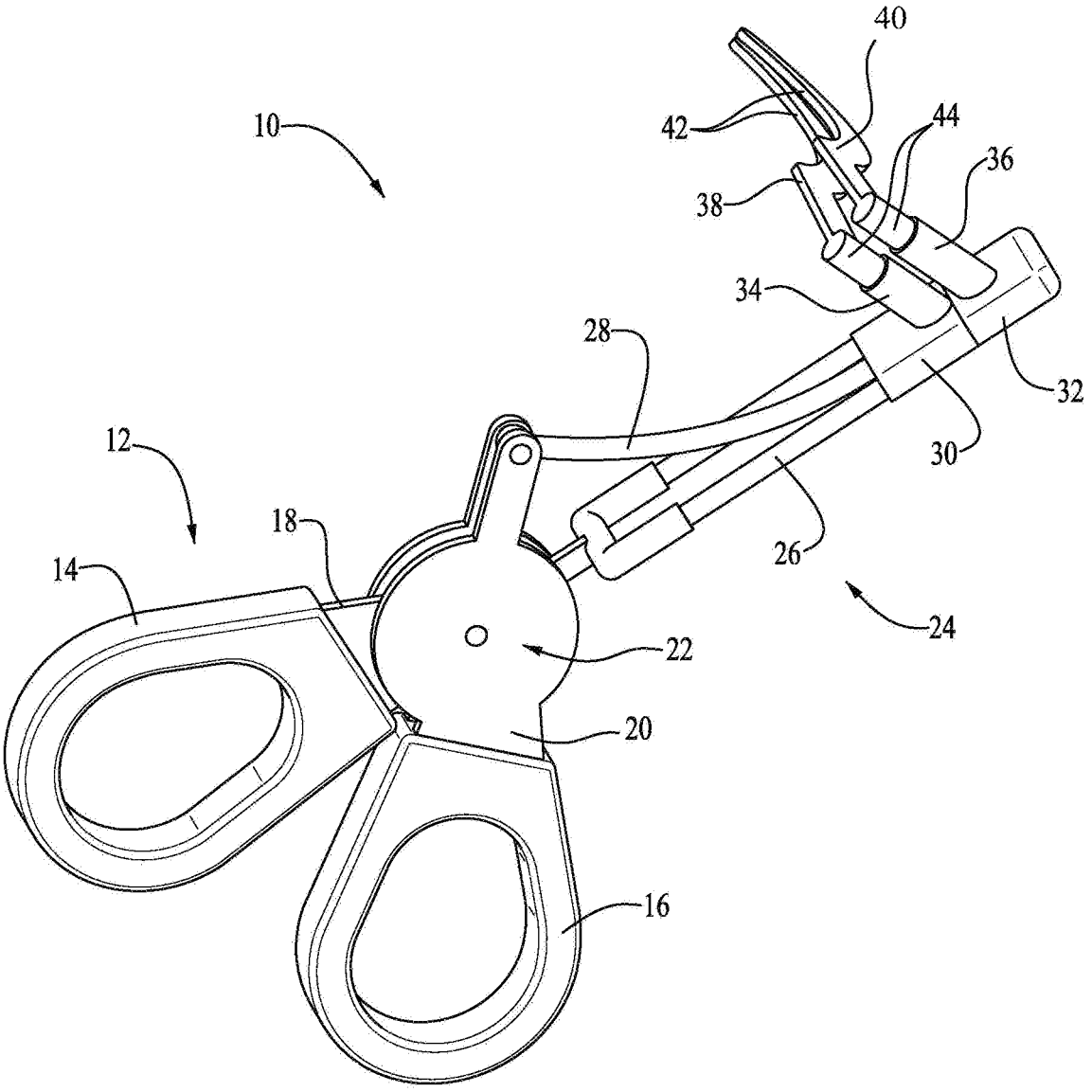
FIG. 1 illustrates a perspective view of a false eyelash application and removal apparatus.

Referring to FIG. 1, a false eyelash application and removal apparatus 10 comprises a handle portion 12 having a first eye ring 14 and a second eye ring 16. The first eye ring 14 and the second eye ring 16 articulate relative to one another and are preferably sized and shaped to be held in a manner similar to a conventional scissoring apparatus. The first eye ring 14 and the second eye ring 16 preferably include a first stem 18 and a second stem 20 joined at a hub 22. In preferred embodiments, the first stem 18 and the second stem 20 may be of various preferred lengths, or in an alternative embodiment, the first eye ring 14 and second eye ring 16 may be connected directly to the hub 22.

Figure 5:
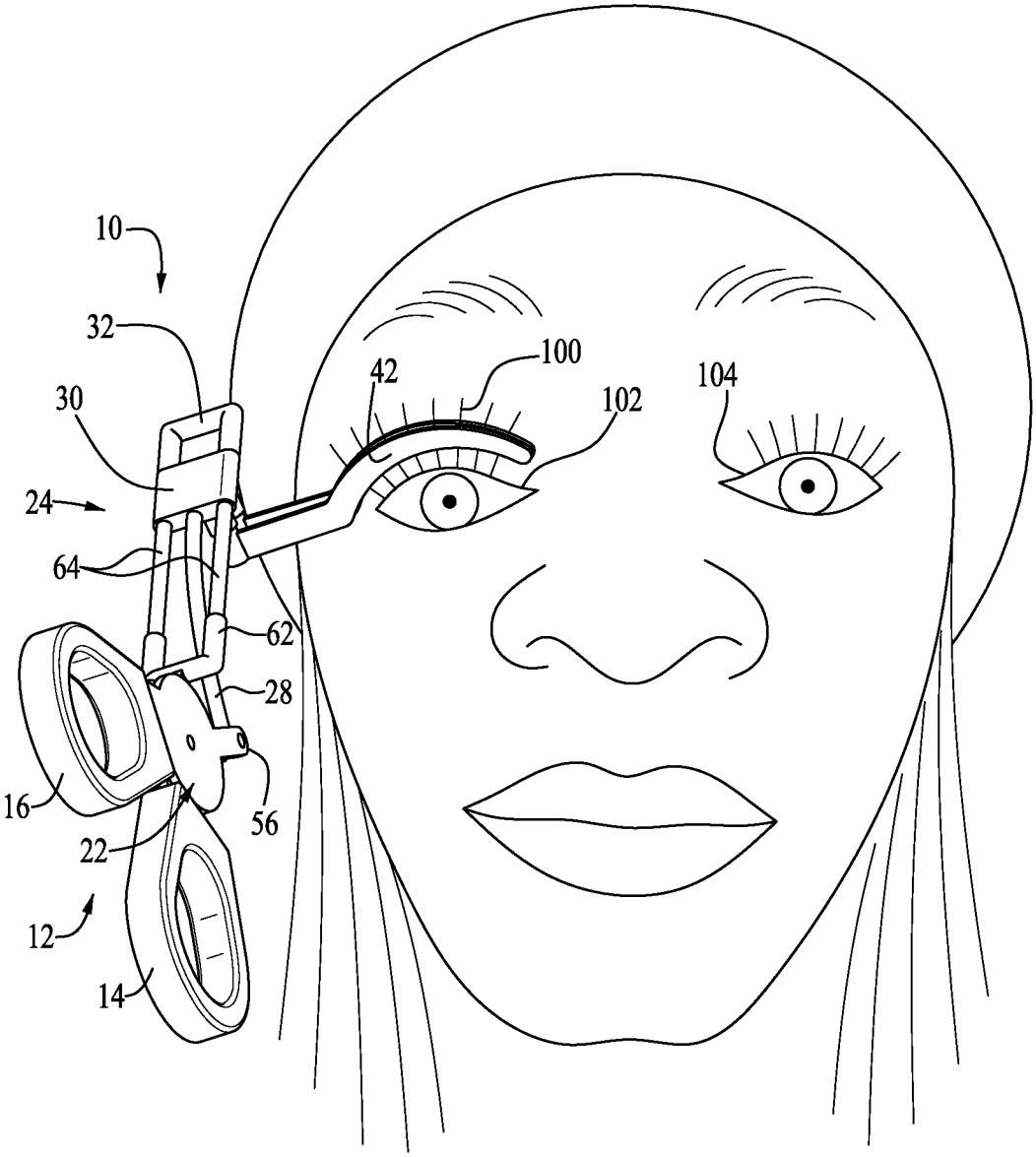
FIG. 5 illustrates a user applying a false eyelash with the apparatus in the closed configuration.

Also connected to the hub 22 is an applicator portion 24 for engaging a false eyelash 100 (FIG. 5). The applicator portion 24 principally comprises a slide 26 and a slider cable 28. The slider cable 28 moves a sliding first applicator support 30 along the slide 26. Preferably the slider cable 28 moves the first applicator support 30 toward the hub 22 when the first eye ring 14 and second eye ring 16 are moved away from each other, and moves the first applicator support 30 away from the hub 22 when the first eye ring 14 and second eye ring 16 are moved toward each other. A second applicator support 32 is disposed on the slide 26 distal from the hub 22. Preferably the second applicator support 32 is held in a static position relative to the hub 22 and therefore and does not move relative to the slide 26.

The first applicator support 30 includes a first applicator anchor 34, and the second applicator support 32 includes a second applicator anchor 36. In various embodiments, the first applicator anchor 34 and second applicator anchor 36 may be molded with, or integrally formed as part of the first applicator support 30 and second applicator support 36, respectively. The first applicator anchor 34 and the second applicator anchor 36 preferably extend away from the slide 26 at a predetermined angle, including at an angle ergonomically suitable for orienting the false eyelash 100 relative to a user's eyelid 102 when the apparatus 10 is held by the user.

Still referring to FIG. 1, a first applicator 38 and a second applicator 40 are used to grasp the false eyelash 100 for application to, or removal from a user's eyelid 102. Both the first applicator 38 and the second applicator 40 include an arced member 42 and a post 44. The arced members 42 grasp the false eyelash 100, while the posts 44 anchor the first applicator 38 and the second applicator 40 into the first applicator anchor 34 and the second applicator anchor 36, respectively. Preferably the arced members 42, have an arc substantially complimentary to the user's eyelid 102 for effectively connecting the entire adhesive portion (not shown) of the false eyelash 100 against the user eyelid 102 at once. Additionally, the arced members 42 are preferably flattened, allowing them to more effectively grasp a false eyelash 100 close to its adhesive portion 104.

Figure 2:
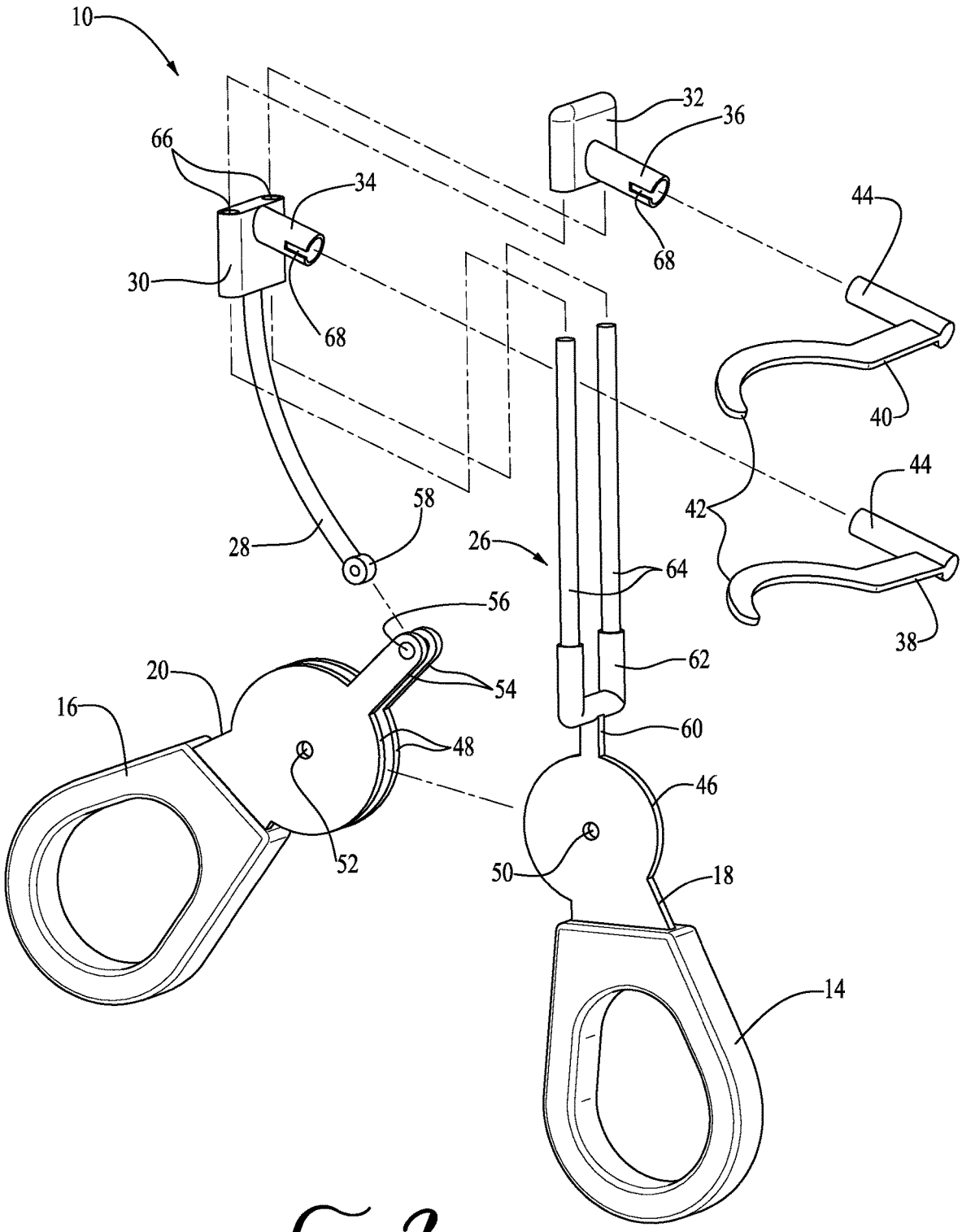
FIG. 2 illustrates an exploded view of the apparatus.

Referring to FIG. 2, the apparatus 10 is shown in exploded view. In one preferred embodiment, the hub 22 (FIG. 1) is formed by a first hub member 46, preferably formed integrally with the first stem 18 and coupled to the first eye ring 14. In such an embodiment, the hub 22 is also formed by second hub members 48. In one embodiment the second hub members 48 may be formed to have a common peripheral contour with the first hub member 46 (i.e., the first hub member 46 and second hub members 48 are of substantially similar size and shape). In other contemplated embodiments, they may be differently sized, as shown in the illustration, or may be shaped differently. In one alternative embodiment, only one second hub member 48 may be used according to preference. In virtually all embodiments, the first hub member 46 and one or more second hub members 48 rotate about a center axis point about which they are rotationally coupled.

For effective fixation and rotation, the first hub member 46 may include a first center hole 52 and the second hub members 48 may include at least one second center hole 54 for accommodating a fastener (not shown) or similar coupling.

The second hub members 48 preferably include one or more slider controllers 54 extending from the second hub members 48 opposite the second eye ring 16. The slider controllers 54 preferably include attachment holes 56 at their terminal ends away from the second hub members 48. For fixation to the slider controllers 54, the slider cable 28 may include an attachment ring 58, opposite the first applicator support 30, with the attachment ring 58 configured for insertion between the attachment holes 56 of the slider controllers 54 and connection with a fastener (not shown), thus allowing the slider cable 28 to rotate relative to the slider controllers 54, as the slider cable 28 moves the first applicator support 30 toward and away from the second applicator support 32.

Still referring to FIG. 2, in a preferred embodiment, the first hub member 46 includes a slide support 60 affixed relative to, and optionally, formed integrally with the slide 26. The slide 26 may be formed as a rail system having a rail support 62 for holding two rails 64 along which the first applicator support 30 slides. As shown in the illustration, the rails 64 extend from the rail support 62 away from the first eye ring 14 and the second eye ring 16, and terminate at the second applicator support 32, which is preferably configured for the rails 64 to be inserted therein. Also preferably, the rail support 62 and the second applicator support 32 hold the rails 64 in a substantially parallel orientation, thereby allowing the first applicator support 30 to slide along the rails 64 on rail guides 66 incorporated into the first applicator support 30.

In various other embodiments, a different rail system may be configured to use only one, or greater than two rails 64, however the illustrated embodiment represents a preferred version of the apparatus 10 since the two rails 64 ensure that the first applicator support 30 and the second applicator support 32 retain their orientation with respect to each other. Maintenance of that orientation is important for ensuring the arced members 42 of the first applicator 38 and the second applicator 40 match up evenly when brought together to effectively and securely hold the false eyelash 100, which typically is very small and difficult to grasp with a user's fingers. In other preferred embodiments, the slide 26, including the slide support 60, rails 64, and second applicator support 32 may be molded as a single unitary piece, thus allowing for a more unitary construction with fewer moving parts to the apparatus 10, which helps reduce costs and assembly time.

Still referring to FIG. 2, the posts 44 of the first applicator 38 and the second applicator 40 are preferably removable from the first applicator anchor 34 and the second applicator anchor 36, respectively. This allows a user to remove the first applicator 38 and the second applicator 40 having a first arced shape, and replace them with new applicators (not shown) having a second, different, arced shape according to user preference and more importantly, the particular curvature of a user's eyelid 102. It is anticipated multiple applicators may be included with the apparatus 10 upon sale to allow users to easily customize the apparatus 10 according to preference.

In such an embodiment, due to the small size of the parts and subsequent difficulty with manipulating them, the first applicator anchor 34 and the second applicator anchor 40, along with the posts 44 or other part of the first applicator 38 and second applicator 40 preferably include a locking feature such as a notch 68. The first applicator 38 and the second applicator 40 anchor can be anchored into the notches 68 to align the first applicator 38 with the second applicator 40 and by extension align their arced members 42.

Together, the first applicator anchor 34 and the second applicator anchor 36, along with the notches 68 preserve the arced members 42 in alignment with each other, and preferably at a substantially ninety degree or similar angle to the slide 26. Such an angle allows a user's fingers installed in the first eye ring 14 and the second eye ring 16 to remain in a natural position, while the first applicator 38 and the second applicator 40 are parallel to the installation surface of the user's eyelid 102, thus allowing installation of the false eyelash 100 while avoiding unusual and frequently stressful arm and hand positions by the user. Importantly, locking features, such as the notches 64 illustrated, allow the first applicator 38 and the second applicator 40 to be removed and reinstalled in a reverse orientation, thereby allowing the apparatus 10 to be used for applying false eyelashes 100 to a user's right eyelid 102 and left eyelid 104, in any order preferred by the user.

Figure 3:
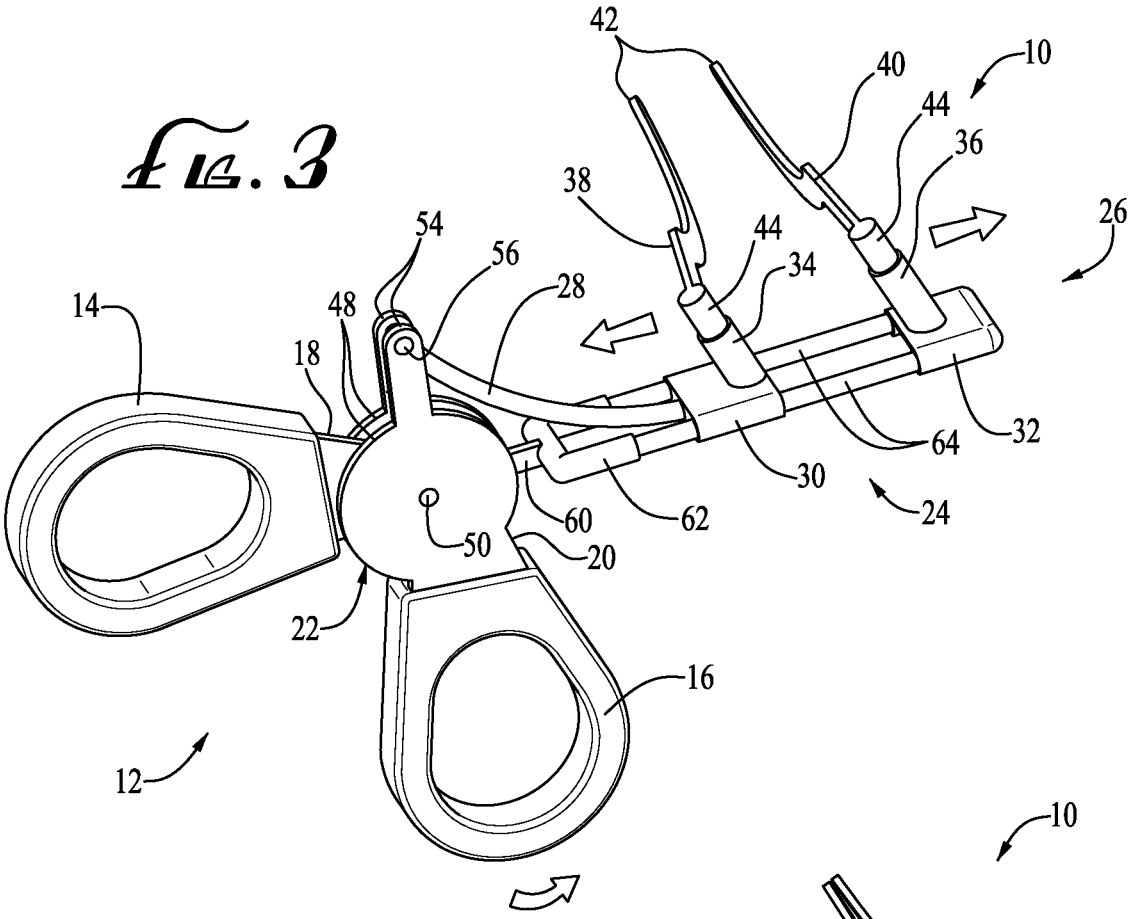
FIG. 3 illustrates the apparatus held by a user in an open configuration prior to securing a false eyelash.

Referring to FIG. 3, the apparatus 10 is shown as it would be held by a user in an open position. This position typifies the state of the apparatus 10 either prior to securing a false eyelash 100, or just after releasing a false eyelash 100. Preferably with the user's finger in the first eye ring 14 and the user's thumb in the second eye ring 16, the user brings the apparatus 10 into the illustrated configuration by separating the first eye ring 14 and second eye ring 16 in a manner similar to a conventional scissors. In the process, the second hub member 48 rotates relative to the first hub member 46, causing the slider controllers 54 to move away from the applicator portion 26. As the slider controllers 54 move, they pull on the slider cable 28, urging the first applicator support 30 to travel toward the hub 22 along the rails 64. This process separates the first applicator 38 from the second applicator 40, thus separating the arced members 42 while retaining them in their parallel orientation. The apparatus 10 can then be brought adjacent a false eyelash 100, either in its case or installed on a user's eyelid 102, for grasping and either applying it to, or removing it from, the user's eyelid 102.

Figure 4:
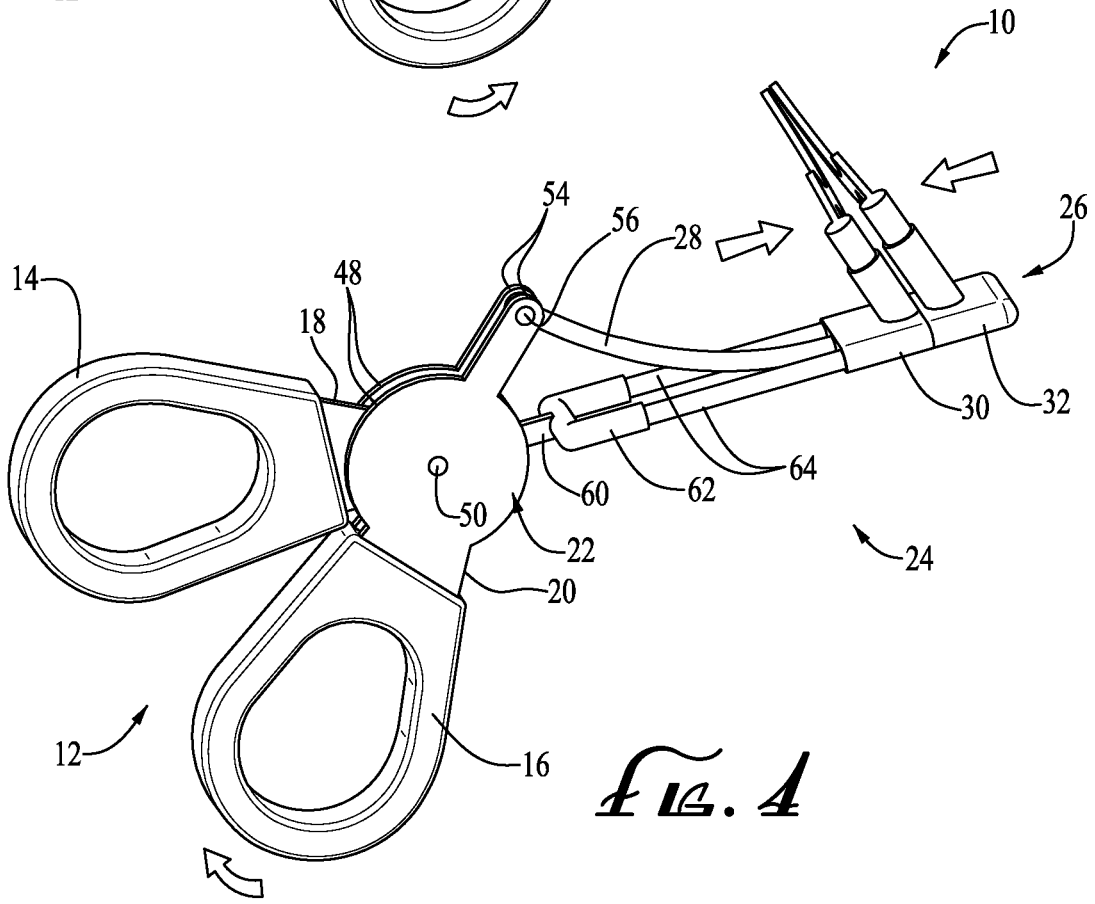
FIG. 4 illustrates the apparatus held by a user in a closed configuration for holding a secured false eyelash.

Referring to FIG. 4, the apparatus 10 is shown as it would be held by a user in a closed position. This position typifies the state of the apparatus 10 once a false eyelash 100 is secured, either from storage prior to administration of an adhesive and/or installation on the user's eyelid 102, or on the user's eyelid 102 prior to removal of the false eyelash 100. By bringing the first eye ring 14 and the second eye ring 16 together, the first hub member 46 rotates relative to the second hub member 50, causing the slider controllers 54 to move toward the slide 26. As the slider controllers 56 move, they push the slider cable 28, thereby urging the first applicator support 30 to travel toward the hub 22 along the rails 64 of the slide 26. This process brings the first applicator 38 adjacent the second applicator 40, thus bringing the arced members 42 together. Once the arced members 42 have secured a false eyelash [##], a user can easily manipulate it, and either place it on or remove it from the user's eyelid, or place it in or remove it from its case.

Referring to FIG. 5, the apparatus 10 is shown in use in the process of installing a false eyelash 62 on the user's right eyelid, or alternatively, removing a false eyelash 62 from the user's eyelid. With the apparatus 10 held in the position shown in FIG. 3, the first eye ring 14 and second eye ring 16 are manipulated to bring them closer together, thereby moving the arced members 42 of the first applicator 38 and the second applicator 40 together, to sandwich the false eyelash 62 between the arced members 42. In order to repeat the process for the user's left eyelid, the first applicator 38 and the second applicator 40 are removed from the first applicator anchor 34 and the second applicator anchor 36, respectively and re-installed thereon in reverse.

The structure and components of the apparatus 10 having been shown and described, its method of operation will now be discussed.

In order to use the apparatus 10, the user first obtains a case bearing a set of false eyelashes 100, and an eyelash adhesive (not shown) which typically comes in an applicator such as a brush (not shown). Alternatively the false eyelashes 100 may have adhesive already installed thereon. The user then installs the first applicator 38 on the first applicator anchor 34 and installs the second applicator 40 on the second applicator anchor 36 such that the arced members 42 are both aimed in the same direction complimentary to the user's eyelid 102.

The user then inserts a finger 58 into the first eye ring 14 and a thumb 60 into the second eye ring 16 and manipulates the apparatus 10 to move the first eye ring 14 and the second eye ring 16 apart. In the process, the slider controllers 54 pull the slider cable 28, urging and the first applicator support 30 away from the second applicator support 32 at the end of the slide 26, and toward the slide support 60 adjacent the hub 22. This spreads apart the first applicator anchor 34 and second applicator anchor 36, and by extension the first applicator 38 and second applicator 40 and their respective arced members 42.

The user then aligns the separated first applicator 38 and second applicator 40 on either side of a false eyelash 100, such that the arced members 42 are arced complimentary to the adhesive bearing portion of the false eyelash 100. The user then manipulates the apparatus 10 to bring the first eye ring 14 and the second eye ring 16 together. In the process, the slider controllers 54 rotate toward the slide 26, causing the slider cable 28 to urge the first applicator support 30 along the rails 64 via the rails supports 62 toward the second applicator support 32. In the process the first applicator anchor 34 and the second applicator anchor 34 are brought together, and by extension the first applicator 38 and second applicator 40 and their respective arced members are brought together, sandwiching the false eyelash 100 at a location proximal to its adhesive portion.

The user then brings the apparatus up until the arced members 42, and by extension, the false eyelash 100 adjacent to the user's eyelid 102. Due to the orientation of the arced members 44 relative to the first eye ring 14 and the second eye ring 16, the user can accomplish this task without forcing the users hand or arm into an un-natural or strained position, allowing the user to more accurately place the false eyelash 100 on the user's eyelid 102 at exactly the intended location. Once the false eyelash 100 is adhered to the user's eyelid 102, the user simply separates the first eye ring 14 and the second eye ring 16 in the manner described above. Doing so causes the arced members 44 to separate, releasing the false eyelash 100 and leaving it on the user's eyelid 102.

With one false eyelash 100 installed on a first eyelid 102, the user may remove the first applicator 38 and the second applicator 40, and reinstall them in a reverse position relative to the slide 26 to carry out the same process for the user's left eyelid 104. It is contemplated that upon initially opening the packaging for the apparatus 10, the user may have to select from among several applicators and test them on the user's eyelid 102 to find the most appropriately sized first applicator 38 and second applicator 40.

Removal of false eyelashes 100 is accomplished by taking the same actions in reverse, namely, grasping the false eyelash 100 on a user's eyelid 102 by manipulating the first eye ring 14 and the second eye ring 16 together, thereby bringing the arced members 42 together to clamp down on the false eyelash 100. The user then pulls the apparatus 10 away from the user's face, thus pulling the false eyelash 100 from the user's eyelid 102. The false eyelash can then be placed in its case and released by separating the first eye ring 14 and the second eye ring 16, and by extension the arced members 42. By reinstalling the first applicator 38 and the second applicator 40 in a reverse position, a false eyelash 100 on the user's opposite eyelid 104 can be removed. The false eyelashes 100 and the apparatus 10 can then be easily and conveniently stored until the next use.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. An apparatus configured for applying and removing false eyelashes, the apparatus comprising:

a handle portion comprising a first eye ring and a second eye ring, the handle portion coupled to a hub configured for allowing the first eye ring and the second eye ring to rotate relative to each other about the hub;

an applicator portion coupled to the hub, the applicator portion comprising a slide;

a first applicator support and a second applicator support arranged on the slide;

a first applicator configured to move along the slide, and a second stationary applicator disposed on a distal end of the slide distal from the hub, the first applicator and the second applicator each comprising:

a substantially straight flattened elongated portion joined directly to a flattened curved portion, the straight elongated portion and the curved portion both extending perpendicularly away from the slide and the handle;

the first applicator and the second applicator being identical and each extending away from the slide, substantially perpendicular to the slide, and extending beyond the slide perpendicularly;

the first applicator and the second applicator each having a post extending from the straight flattened elongated portion, the post of the first applicator and the second applicator anchoring into a corresponding applicator anchor on the first applicator support and the second applicator support, respectively; and a slider controller coupled to the hub and the slide, configured such that bringing the first eye ring and the second eye ring together urges the first applicator toward the second applicator for grasping the false eyelashes with the curved portions.

2. The apparatus of claim 1 wherein the hub comprises a first hub member coupled to the first eye ring, and a second hub member coupled to the second eye ring.

3. The apparatus of claim 1 further comprising a first stem and a second stem extending from the hub, the first stem supporting the first eye ring and the second stem supporting the second eye ring.

4. The apparatus of claim 1 further comprising a slider cable coupled to the slider controller.

5. The apparatus of claim 1 wherein the first applicator support and the second applicator support are arranged to hold the first applicator and the second applicator in a parallel configuration.

6. The apparatus of claim 1 wherein the slide comprises at least one rail and the first applicator is configured to move along the rail.

7. The apparatus of claim 1 further comprising a first applicator support having a notch, wherein the first applicator is configured to seat in the notch thereby preserving the orientation of the first applicator relative to the handle portion.

8. The apparatus of claim 1 wherein the hub is configured such that the first eye ring is in a fixed position relative to the slide and the second eye ring rotates about the hub relative to the slide.

9. An apparatus configured for applying and removing false eyelashes, the apparatus comprising:

a handle portion comprising a first eye ring and a second eye ring, the first eye ring and the second eye ring configured for engaging a thumb and a forefinger of a user;

the first eye ring and the second eye ring coupled to a hub having a first hub member rotatably affixed to a second hub member;

an applicator portion coupled to the hub, the applicator portion comprising a slider cable and a slide having a rail;

the slider cable coupled to a first applicator support comprising a first applicator anchor, the first applicator support being configured to slide along the rail and a slider controller affixed to the hub;

the applicator portion further comprising a second applicator support comprising a second applicator anchor, the second applicator support being stationary and affixed to the rail distal from the hub;

a first applicator having a post installed on the first applicator anchor first applicator support and a second applicator installed on the anchor of the second applicator support, the first applicator and the second applicator being identical and each comprising:

a member having a flattened linear portion, and a flattened curved portion extending from the flattened linear portion away from the slide, such that the flattened curved portion is distal from the first applicator support and the second applicator support, and such that the first applicator and the second applicator are disposed substantially perpendicular to the rail; and wherein the hub is arranged such that the second eye ring and the slider controller rotate in tandem, and the first eye ring and the second eye ring are arranged such that separating them urges the slider controller and the slider cable to move the first applicator support toward the hub along the rail, thereby separating the curved portions.

10. The apparatus of claim 9 wherein the rail comprises a pair of parallel members extending from the hub, and wherein the first applicator support comprises a pair of guides configured to slide along the pair of parallel members.

11. The apparatus of claim 10 wherein the pair of parallel members are held parallel by a slide support proximal to the hub and by the second applicator support distal from the hub.

12. The apparatus of claim 9 wherein the first applicator and the second applicator are disposed substantially perpendicular to the slide.

13. The apparatus of claim 9 wherein the hub is configured such that the first eye ring is fixed relative to the slide and the second eye ring rotates about the hub relative to the slide.

* * * * *